US011022314B2

(12) United States Patent
Yoshino et al.

(10) Patent No.: US 11,022,314 B2
(45) Date of Patent: Jun. 1, 2021

(54) FUEL INJECTOR, COMBUSTOR, AND GAS TURBINE

(71) Applicant: MITSUBISHI HEAVY INDUSTRIES, LTD., Tokyo (JP)

(72) Inventors: Ryo Yoshino, Tokyo (JP); Keijiro Saito, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/356,382

(22) Filed: Mar. 18, 2019

(65) Prior Publication Data

US 2019/0212010 A1 Jul. 11, 2019

Related U.S. Application Data

(62) Division of application No. 14/910,462, filed as application No. PCT/JP2013/078277 on Oct. 18, 2013, now Pat. No. 10,274,200.

(51) Int. Cl.
*F23R 3/28* (2006.01)
*F23R 3/32* (2006.01)
(Continued)

(52) U.S. Cl.
CPC ..... *F23R 3/286* (2013.01); *F23R 3/045* (2013.01); *F23R 3/10* (2013.01); *F23R 3/32* (2013.01);
(Continued)

(58) Field of Classification Search
CPC .. F23R 3/045; F23R 3/286; F23R 3/32; F23R 3/10; F23D 11/40; F23D 14/64;
(Continued)

(56) References Cited

U.S. PATENT DOCUMENTS 2,474,547 A * 6/1949 Patch ..... F23D 14/10 431/80
2,612,023 A * 9/1952 Morrison ..... F23R 3/32 60/738
(Continued)

FOREIGN PATENT DOCUMENTS

CN 101725986 6/2010
CN 102012043 4/2011
(Continued)

OTHER PUBLICATIONS

International Search Report dated Nov. 12, 2013 in corresponding International Application No. PCT/JP2013/078277 (with English Translation).
(Continued)

*Primary Examiner* — Gerald L Sung
*Assistant Examiner* — Marc J Amar
(74) *Attorney, Agent, or Firm* — Wenderoth, Lind & Ponack, L.L.P.

(57) ABSTRACT

An injector includes: an upstream support plate into which a fuel gas is to be introduced and which has a shape of a tapered cylinder with a diameter which enlarges; a downstream support plate that defines a plenum at an inner side along with the upstream support plate; and premixing tubes, each of which is supported by the upstream support plate and the downstream support plate and is configured to introduce air. The premixing tubes are disposed in circular rows at
(Continued)

equal intervals in a circumferential direction, and portions of the premixing tubes which are located in the plenum include fuel introducing holes.

2 Claims, 5 Drawing Sheets

(51) Int. Cl.
*F23R 3/10* (2006.01)
*F23R 3/04* (2006.01)
*F23D 14/62* (2006.01)
*F23D 14/64* (2006.01)

(52) U.S. Cl.
CPC ..... *F23D 14/62* (2013.01); *F23D 14/64* (2013.01); *F23R 2900/00014* (2013.01)

(58) Field of Classification Search
CPC ..... F23D 2203/007; F23D 2700/025; F23D 2900/14642
See application file for complete search history.

(56) References Cited

U.S. PATENT DOCUMENTS 2,705,401 A * 4/1955 Allen ..... F23R 3/38 60/743
2,830,439 A * 4/1958 Johnson ..... F23R 3/32 60/737
2,949,012 A * 8/1960 Ferrie ..... F23R 3/32 60/738
3,430,443 A 3/1969 Parnell
3,906,718 A 9/1975 Wood
4,100,733 A 7/1978 Striebel
4,587,809 A 5/1986 Ohmori
4,763,481 A 8/1988 Cannon
4,893,475 A 1/1990 Willis
4,919,849 A * 4/1990 Litz ..... B01F 3/04539 261/123
4,967,561 A * 11/1990 Bruhwiler ..... F23D 23/00 60/737
5,235,814 A 8/1993 Leonard
5,321,948 A 6/1994 Leonard
5,361,586 A 11/1994 McWhirter
5,927,076 A 7/1999 Pillsbury
6,092,363 A * 7/2000 Ryan ..... F02C 3/20 60/39.463
6,415,608 B1 * 7/2002 Newburry ..... F23C 13/00 417/170
6,460,345 B1 * 10/2002 Beebe ..... F23C 13/00 60/723
6,820,424 B2 11/2004 Oechsle
7,578,130 B1 8/2009 Kraemer
8,141,363 B2 3/2012 Khan
8,234,871 B2 8/2012 Davis
8,438,851 B1 5/2013 Uhm
8,464,537 B2 6/2013 Khan
8,511,086 B1 8/2013 Uhm
8,613,197 B2 12/2013 Uhm
8,616,002 B2 12/2013 Kraemer
8,959,921 B2 2/2015 Khan
9,151,503 B2 10/2015 Melton
9,255,711 B2 2/2016 Crothers
9,291,103 B2 3/2016 Belsom
9,322,557 B2 4/2016 Uhm
9,500,370 B2 11/2016 Barker
9,631,816 B2 4/2017 Lum
9,650,959 B2 5/2017 Boardman
9,803,866 B2 10/2017 Yoshino
2003/0010032 A1 * 1/2003 Stuttaford ..... F23R 3/286 60/737
2003/0046935 A1 3/2003 Halila et al.
2008/0053097 A1 3/2008 Han
2008/0268387 A1 10/2008 Saito
2009/0061369 A1 3/2009 Wang
2010/0008179 A1 * 1/2010 Lacy ..... F23R 3/286 366/134
2010/0031662 A1 * 2/2010 Zuo ..... F23R 3/283 60/740
2010/0139280 A1 6/2010 Lacy et al.
2010/0192581 A1 * 8/2010 Ziminsky ..... F23R 3/34 60/737
2010/0218501 A1 * 9/2010 York ..... F23R 3/286 60/737
2010/0248171 A1 * 9/2010 Hayashi ..... F23R 3/343 431/196
2010/0252652 A1 10/2010 Johnson
2010/0275603 A1 11/2010 Saito
2011/0057056 A1 3/2011 Ziminsky et al.
2011/0073684 A1 3/2011 Johnson
2011/0083439 A1 4/2011 Zuo
2012/0055167 A1 3/2012 Johnson et al.
2012/0180487 A1 7/2012 Uhm
2012/0180495 A1 7/2012 Uhm
2012/0198856 A1 8/2012 Uhm
2013/0045450 A1 2/2013 Uhm
2013/0061593 A1 * 3/2013 York ..... F23N 5/082 60/722
2013/0074510 A1 * 3/2013 Berry ..... F23R 3/36 60/772
2013/0084534 A1 4/2013 Melton et al.
2013/0104552 A1 5/2013 Uhm et al.
2013/0104556 A1 * 5/2013 Uhm ..... F23L 7/005 60/772
2013/0115561 A1 5/2013 Melton
2013/0122434 A1 * 5/2013 Stoia ..... F23R 3/286 431/12
2013/0122435 A1 5/2013 Stoia et al.
2013/0122438 A1 * 5/2013 Stoia ..... F23R 3/286 431/144
2013/0167539 A1 * 7/2013 Berry ..... F23R 3/286 60/737
2013/0186092 A1 * 7/2013 Bathina ..... F23R 3/54 60/737
2013/0192234 A1 * 8/2013 Stewart ..... F23D 14/08 60/772
2013/0213051 A1 * 8/2013 Westmoreland, III ..... F23D 14/62 60/775
2014/0033718 A1 2/2014 Manoharan
2014/0083110 A1 * 3/2014 Stewart ..... F23R 3/286 60/776
2014/0116066 A1 * 5/2014 Melton ..... F23D 11/36 60/806
2014/0157779 A1 6/2014 Uhm
2014/0174858 A1 * 6/2014 Remer ..... F01D 25/18 184/106
2014/0338339 A1 * 11/2014 Westmoreland ..... F23D 14/62 60/737
2015/0076251 A1 * 3/2015 Berry ..... F23R 3/10 239/418
2015/0128607 A1 5/2015 Lee
2015/0135718 A1 5/2015 Hughes
2016/0102863 A1 * 4/2016 Yoshino ..... B05B 1/14 239/428
2016/0146469 A1 5/2016 Lum
2016/0238255 A1 8/2016 Ryon
2016/0290646 A1 10/2016 Abe
2017/0074519 A1 3/2017 Abe
2017/0184308 A1 6/2017 Valeev
2017/0254539 A1 9/2017 Melton
2017/0298827 A1 10/2017 Berry
2017/0299186 A1 10/2017 Berry
2017/0343216 A1 11/2017 McMahan

FOREIGN PATENT DOCUMENTS

CN 102032594 4/2011
CN 103196155 7/2013
CN 103322592 9/2013
JP 9-42672 2/1997

(56) References Cited

FOREIGN PATENT DOCUMENTS

| | | |
|---|---|---|
| JP | 2010-19542 | 1/2010 |
| JP | 2010-243146 | 10/2010 |
| JP | 2011-69602 | 4/2011 |
| JP | 2011-80743 | 4/2011 |
| JP | 2013-139994 | 7/2013 |
| WO | 93/12388 | 6/1993 |

OTHER PUBLICATIONS

Written Opinion of the International Searching Authority dated Nov. 12, 2013 in corresponding International Application No. PCT/JP2013/078277 (with English Translation).
First Office Action dated Sep. 20, 2016 in corresponding Chinese Application No. 201380078684.0, with English Translation of part of the Search Report.
Notice of Allowance dated Sep. 27, 2016 in corresponding Japanese Application No. 2015-542463, with English Translation.
Notice of Preliminary Rejection dated Jan. 4, 2017 in corresponding Korean Application No. 10-2016-7000133 (with English translation).
Extended European Search Report dated May 8, 2017 in corresponding European Application No. 13895662.8.

* cited by examiner

FUEL INJECTOR, COMBUSTOR, AND GAS TURBINE

TECHNICAL FIELD

The present invention relates to a fuel injector.

BACKGROUND ART

When a fuel gas is supplied to a combustor, etc. in a gas turbine or the like, air and the fuel gas are previously uniformly mixed and injected in a mist form by a fuel injector.

As this fuel injector, a fuel injector that has a cylindrical shape to internally form a plenum and has an inner baffle disposed such that a diameter thereof enlarges toward a downstream side is disclosed in, for example, Japanese Unexamined Patent Application, First Publication No. 2011-69602.

The fuel injector has upstream and downstream tube supports connected by an outer wall and is provided with a fuel injector body using an inner space as a plenum. In the fuel injector body, an inner baffle spreading toward an outer side in a radial direction to transverse the inner plenum in the radial direction is disposed. Further, a fuel delivery tube is connected to the fuel injector body from an upstream side thereof. The fuel injector body is provided with a plurality of premixing tubes that penetrate and fix the upstream tube support, the inner baffle, and the downstream tube support. In the premixing tubes, fuel injection holes for introducing a fuel gas are disposed upstream from the inner baffle in the plenum.

In the fuel injector having such a constitution, when the fuel gas is introduced into the plenum from a fuel delivery tube, the fuel gas flows toward the outer side in the radial direction along a downstream surface of the inner baffle to reach the vicinity of the outer wall. Afterwards, the fuel gas in the plenum flows toward the inner side in the radial direction along an upstream surface of the inner baffle while being introduced from the fuel injection holes of the premixing tubes disposed at an outer side in the radial direction. A cross-sectional area of the plenum is reduced toward the inner side in the radial direction. For this reason, a flow rate of the fuel gas in the plenum is gradually reduced toward the inner side in the radial direction. Thereby, in the fuel injection holes of the premixing tubes, a flow velocity of the fuel gas is constant, and an amount of supply of the fuel gas supplied to the premixing tubes is constant. Therefore, in the fuel injector, air supplied from the upstream sides of the premixing tubes and the fuel gas supplied from the fuel introduction holes can be uniformly mixed and injected regardless of positions at which the premixing tubes are disposed.

Technical Problem

In the fuel injector described in Japanese Unexamined Patent Application, First Publication No. 2011-69602, it is important to adjust the inner baffle to a constant angle. However, because the fuel injector is disposed in the plenum that is a closed space in the fuel injector body, it is difficult to adjust to the constant angle.

Further, the inner baffle is formed with a plurality of through-holes for passing the premixing tubes. Welding is performed to prevent inflow of fuel from a space between the premixing tubes and the inner baffle, and unevenness occurs on a surface of the inner baffle. For this reason, it is difficult to smoothly flow the fuel gas along the surface of the inner baffle.

Therefore, it is difficult to adjust the flow velocity of the fuel gas to an arbitrary velocity in the vicinity of the fuel introduction holes, and to uniformly mix and inject the fuel gas in the premixing tubes.

SUMMARY OF INVENTION

The present invention provides a fuel injector, a combustor, and a gas turbine capable of easily injecting a uniformly mixed fuel gas.

Solution to Problem

A fuel injector according to a first aspect of the present invention includes an upstream support plate configured to introduce a fuel gas from a first end side into an inner side in a direction of an axis and having a shape of a tapered cylinder whose diameter gradually enlarges toward a second end side in the direction of the axis; a downstream support plate provided to intersect the axis, disposed at the second end side of the upstream support plate in the direction of the axis, and configured to define a plenum at an inner side along with the upstream support plate; and a plurality of premixing tubes provided to extend in the direction of the axis to be supported on the upstream and downstream support plates and configured to introduce air from the first end side in the direction of the axis, wherein the plurality of premixing tubes are disposed in rows shaped as a plurality of circles whose radial dimensions centered on the axis are different from each other, the neighboring premixing tubes disposed in the same row are disposed equidistantly from each other in a circumferential direction, portions of the premixing tubes which are located in the plenum are formed with fuel introduction holes penetrating the premixing tubes from outside to inside, and the fuel gas supplied from the plenum into the premixing tubes via the fuel introduction holes is mixed with the air in the premixing tubes and is injected from second end sides of the premixing tubes in the direction of the axis.

Such a fuel injector can form the plenum defined inside the upstream and downstream support plates to reduce an axial distance from the center of the center toward the outer side in the radial direction. For this reason, although an amount of circulation of the fuel gas is gradually reduced in the plenum, a flow velocity of the fuel gas supplied from the fuel introduction holes into the premixing tubes provided in plural can be maintained to be constant. Therefore, a flow rate of the fuel gas supplied from the fuel introduction holes into the premixing tubes provided in plural is gradually reduced in the plenum toward the outer side in the radial direction. For this reason, although the premixing tubes are increased, the flow velocity of the fuel gas can be maintained to be constant. As a result, an amount of supply of the fuel gas supplied from the fuel introduction holes located in the plenum into the premixing tubes can be made constant regardless of positions at which the premixing tubes are disposed. Thereby, since the air and the fuel gas can be uniformly mixed by the premixing tubes, the uniformly mixed fuel gas can be easily injected.

In a fuel injector according to a second aspect of the present invention, a length of the plenum in each row in the direction of the axis may be set such that a flow velocity of the fuel gas circulating in circumferential spaces between the plurality of premixing tubes in a radial direction is constant.

In the fuel injector, an axial length of the plenum located in rows whose radius dimensions from the axis are different from each other is set such that the flow velocity of the fuel gas circulating in the circumferential space of the premixing tubes in the radial direction is constant. For this reason, the flow passage area of the fuel gas flowing in the plenum in each row can be adjusted to be small on the whole. As a result, the flow velocity in the radial direction can be made constant with high precision. Thereby, the uniformly mixed fuel gas can be easily injected.

In a fuel injector according to a third aspect of the present invention, when the row at an innermost side in a radial direction is set as a first row, the length of the plenum in an a-th row in the direction of the axis is defined as La, the number of premixing tubes in the a-th row is defined as Na, and a volume flow rate of the fuel gas in the a-th row is defined as Ga, the upstream support plate is configured such that the length La of the plenum in the a-th row in the direction of the axis may be represented by the following formula:

$$La=L1\times Ga/G1\times N1/Na$$

where L1: the length of the plenum in a first row in the direction of the axis,

G1: the volume flow rate of the fuel gas in the first row,

N1: the number of premixing tubes in the first row.

In the fuel injector, the axial length of the plenum is determined by the number of premixing tubes and the volume flow rate of the fuel gas in each row. For this reason, the flow passage area of the fuel gas flowing in the plenum can be more accurately adjusted. Thereby, it is possible to make the flow velocity in the radial direction constant with high precision, and easily inject the fuel gas that is more uniformly mixed.

In a fuel injector according to a fourth aspect of the present invention, the premixing tubes may protrude toward an outer side of the plenum with respect to at least one of the upstream support plate and the downstream support plate in the direction of the axis.

In the fuel injector, the premixing tubes protrude toward the outer side of the plenum in the direction of the axis. For this reason, the lengths of the whole premixing tubes can be increased in the direction of the axis relative to the lengths of the premixing tubes disposed in the plenum. The plenum is formed to reduce the axial distance from the center of the axis toward the outer side in the radial direction. Thereby, the lengths of the premixing tubes disposed in the plenum are reduced toward the outer side in the radial direction. Since a loss of pressure in the premixing tubes is reduced toward the outer side in the radial direction, the premixing tubes disposed in the plenum are subjected to a difference in magnitude of the pressure loss by radial positions at which the premixing tubes are disposed from the axis, and a difference in an amount of air flowing in the premixing tubes occurs. Thus, the premixed gas cannot be uniformed and supplied.

In contrast, the premixing tubes extend toward the outer side of the plenum, and thereby it is possible to reduce the difference of the pressure loss of the premixing tubes in which positions disposed in the radial direction are different. For this reason, despite the positions at which the premixing tubes are disposed, the amount of supply of the fuel gas can be made uniform, and the more uniformly mixed fuel gas can be easily injected.

In a fuel injector according to a fifth aspect of the present invention, the fuel injector may include a fuel guide having a tapered surface whose center is the axis and whose diameter is gradually enlarged from the first end side in the direction of the axis to the second end side in the direction of the axis and fixing to a surface of the first end side of the downstream support plate in the plenum in the direction of the axis.

In the fuel injector, the fuel guide has the tapered surface whose center is the axis and whose diameter is gradually enlarged in the direction of the axis from the first end side toward the second end side. Thereby, the fuel gas in the plenum is guided toward the outer side in the radial direction by the fuel guide, and easily circulates toward the outer side in the radial direction. For this reason, the fuel gas is also easily supplied to the premixing tubes disposed at the outer side in the radial direction, and an amount of the fuel gas supplied from the fuel introduction holes can be made constant with higher precision regardless of the positions at which the premixing tubes are disposed. Thereby, the fuel gas uniformly mixed with high precision can be easily injected.

Advantageous Effects of Invention

According to the aforementioned fuel injector, the plenum is formed to reduce the axial distance from the center of the axis toward the outer side in the radial direction, and thereby the uniformly mixed fuel gas can be easily injected.

DESCRIPTION OF EMBODIMENTS

Hereinafter, a fuel injector 10 of a first embodiment of the present invention will be described with reference to FIGS. 1 and 2.

In the fuel injector 10 of the present embodiment, a fuel gas F is introduced from a first end side in a direction of an axis O by a fuel delivery tube 1 extending along the axis O. The fuel injector 10 mixes the fuel gas F and air A, and then injects and discharges the mixture toward the second end side in the direction of the axis O. If the first end side in the direction of the axis O is defined as an upstream side (the left side of FIG. 1) into which the fuel gas F is introduced, and the second end side in the direction of the axis O is defined as a downstream side (the right side of FIG. 1) into which the fuel gas F is injected, the fuel gas F and the air A circulate from the upstream side toward the downstream side.

Figure 1:
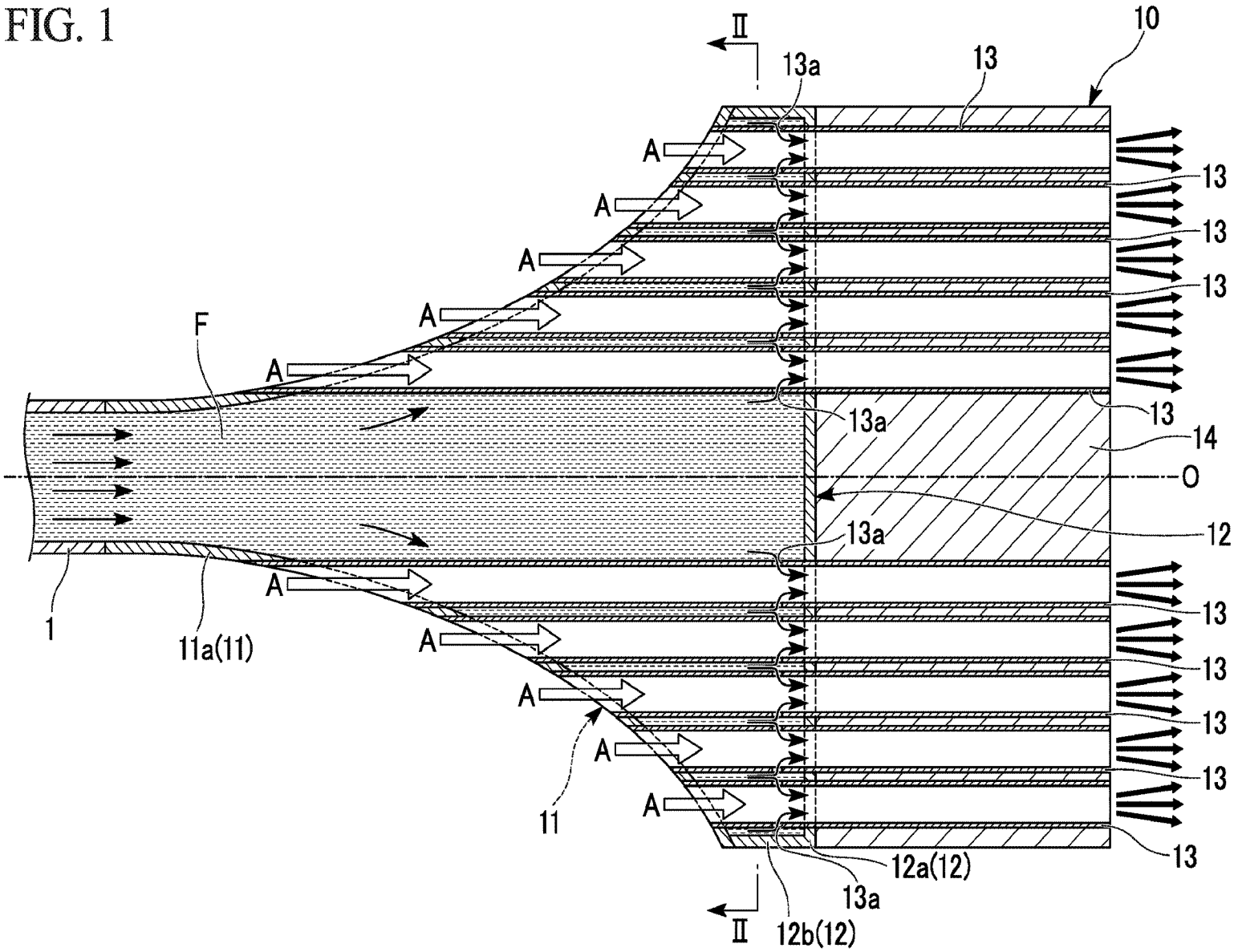
FIG. 1 is a longitudinal cross-sectional view showing a fuel injector according to a first embodiment of the present invention.
Figure 2:
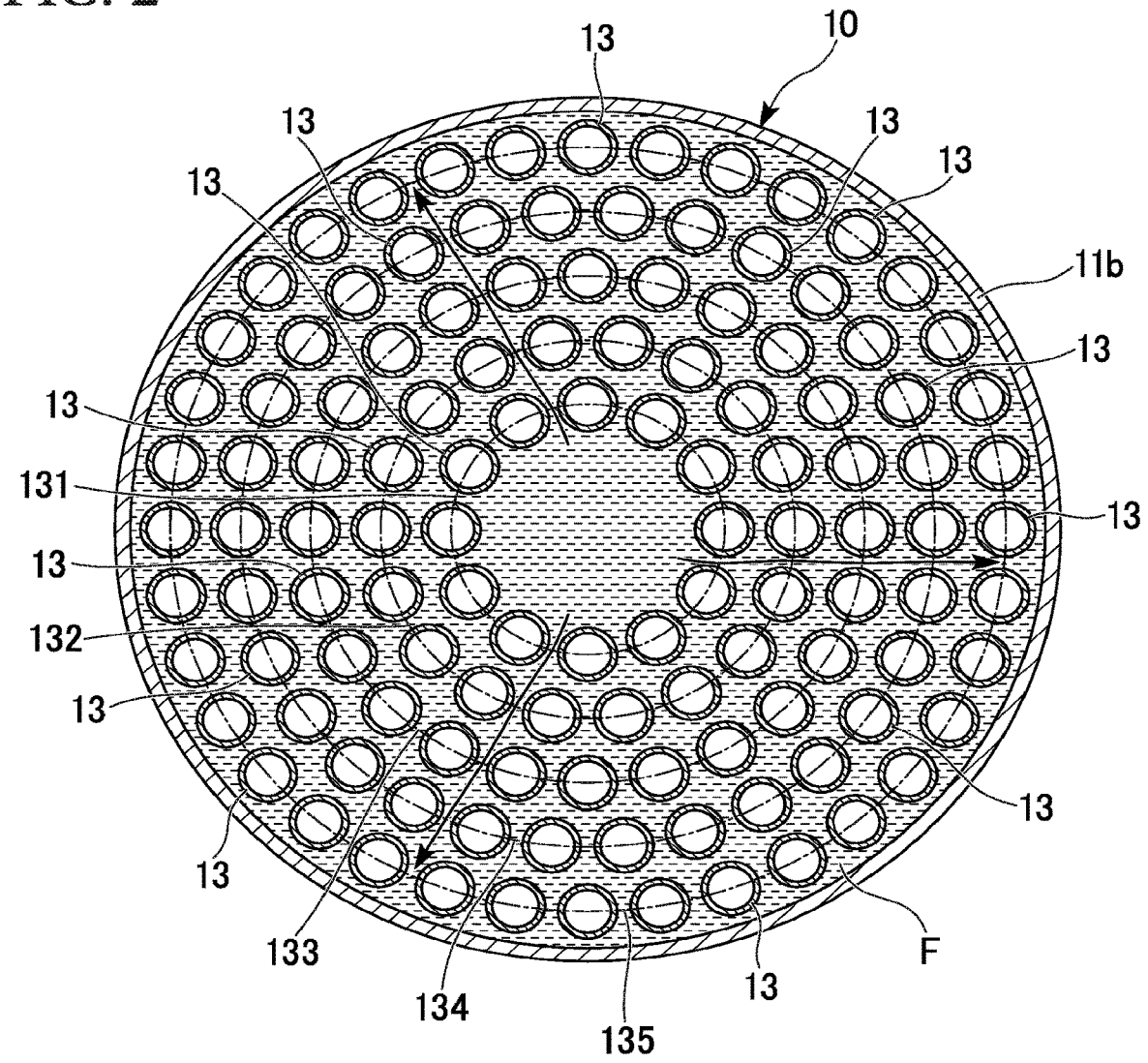
FIG. 2 is a transverse cross-sectional view taken along line II-II of FIG. 1 showing the fuel injector according to the first embodiment of the present invention.

As illustrated in FIG. 1, the fuel injector 10 is provided with an upstream support plate 11 connected with the fuel delivery tube 1, a downstream support plate 12 defining a plenum along with the upstream support plate 11, a plurality of premixing tubes 13 supported by the upstream support plate 11 and downstream support plate 12, and a premixing tube support 14 supporting the premixing tubes 13 at the downstream side from the downstream support plate 12.

The upstream support plate 11 is connected with the fuel delivery tube 1 for introducing the fuel gas F from the upstream side. The upstream support plate 11 has the shape of a tapered tube whose diameter gradually enlarges toward the second end side in the direction of the axis O. To be specific, an interior of the upstream support plate 11 has a hollow shape. The upstream support plate 11 has an enlarged diameter part 11*a* which is connected with the fuel delivery tube 1 and whose diameter gradually enlarges toward the second end side in the direction of the axis O.

The enlarged diameter part 11*a* is connected with the fuel delivery tube 1. The enlarged diameter part 11*a* has the same diameter as the fuel delivery tube 1 at a portion connected with the fuel delivery tube. The enlarged diameter part 11*a* is formed such that a diameter thereof gradually enlarges from the first end side toward the downstream side that is the second end side in the direction of the axis O.

The downstream support plate 12 is disposed across the axis O at the second end side of the upstream support plate 11 in the direction of the axis O. To be specific, the downstream support plate 12 has the shape of a disc whose center is the axis O. The downstream support plate 12 has a disc part 12*a* that is integrally connected with a cylindrical part 12*b* at the downstream side, and the cylindrical part 12*b* that has the shape of a cylinder connected to a first end side of the disc part 12*a* in the direction of the axis O. Along with the enlarged diameter part 11*a* of the upstream support plate 11, the disc part 12*a* and the cylindrical part 12*b* of the downstream support plate 12 define a plenum that is a space inside these parts.

The disc part 12*a* has the shape of a disc whose center is the axis O. The disc part 12*a* is formed with a plurality of through-holes for inserting and supporting the plurality of premixing tubes.

A first end side of the cylindrical part 12*b* in the direction of the axis O is connected to the largest diameter portion of the enlarged diameter part 11*a* of the upstream support plate 11. A second end side of the cylindrical part 12*b* in the direction of the axis O is integrally formed with an outer circumferential portion of the disc part 12*a*. The cylindrical part 12*b* is fitted to the largest diameter portion of the enlarged diameter part 11*a* and extends in the direction of the axis O to have a cylindrical shape.

The premixing tubes 13 are pipe members having the shape of cylinders extending in the direction of the axis O. Air A is introduced into the premixing tubes 13 from the upstream side that is the first end side in the direction of the axis O. The premixing tubes 13 are fixed such that second end sides thereof in the direction of the axis O protrude to the downstream side that is the second end side in the direction of the axis O toward the outside of the plenum relative to the downstream support plate 12. The premixing tubes 13 are fixed such that the first end sides thereof in the direction of the axis O are flush with the enlarged diameter part 11*a* without protruding from the enlarged diameter part 11*a* of the upstream support plate 11. Portions of the premixing tubes 13 which protrude from the downstream support plate 12 are supported by the premixing tube support 14 to be described below. Portions of the premixing tubes 13 which are located in the plenum are formed with fuel introduction holes 13*a* that penetrate the premixing tubes 13 from outside to inside in a radial direction.

The plurality of premixing tubes 13 are disposed through the upstream support plate 11 and downstream support plate 12 in the direction of the axis O. The premixing tubes 13 are fixed and supported by the upstream support plate 11 and downstream support plate 12. The plurality of premixing tubes 13 all have the same cross-sectional shape. On the other hand, the plurality of premixing tubes 13 are fixed to be flush with the upstream support plate 11 without protruding from the upstream support plate 11. Thereby, the premixing tubes 13 have a length different from each other and are disposed in a plurality of circular rows whose radial dimensions centering on the axis O are different from each other. The premixing tubes 13 that are disposed in the same row and are adjacent to each other are disposed an equal distance t apart from each other in a circumferential direction. That is, the plurality of premixing tubes 13 are radially disposed in a plurality of rows and are separated at even intervals in the circumferential direction. As a result, the plurality of premixing tubes 13 are radially disposed around the axis O such that their number is gradually increased toward the outer side in the radial direction. For example, as illustrated in FIG. 2, the premixing tubes 13 of the present embodiment are disposed in five circles whose diameters gradually increase starting from the axis O. In the present embodiment, the premixing tubes 13 are configured in such a manner that 12 premixing tubes are disposed in a first row 131 that is a circle closest to the axis O, 18 premixing tubes are disposed in a second row 132, 24 premixing tubes are disposed in a third row 133, 30 premixing tubes are disposed in a fourth row 134, and 36 premixing tubes are disposed in a fifth row 135 that is a circle farthest from the axis O.

The fuel introduction holes 13*a* are through-holes through which the fuel gas F in the plenum flows into the premixing tubes 13. The fuel introduction holes 13*a* are formed in portions of the premixing tubes 13 which are located in the plenum. The fuel introduction holes 13*a* have circular cross-sections, and pass through the premixing tubes 13 in a radial direction. The fuel introduction holes 13*a* are disposed in the plenum at the same position in the direction of the axis O regardless of positions at which the premixing tubes 13 are disposed.

The upstream support plate 11 is formed such that a diameter thereof gradually increases while a length of the defined plenum in the direction of the axis O is adjusted. That is, the diameter of the upstream support plate 11 is enlarged to set lengths of the plenums, which are located in rows whose radial dimensions from the axis O are different from each other, in the direction of the axis O such that a flow velocity of the fuel gas F circulating in circumferential spaces between the premixing tubes 13 in a radial direction is constant. In the first embodiment, for example, with the increase of the radial dimensions of the rows disposed such that the flow velocity of the fuel gas F circulating in the circumferential spaces between the premixing tubes 13 disposed in the first row 131 in the radial direction is the same as the flow velocity of the fuel gas F circulating in the circumferential spaces between the premixing tubes 13 disposed in the fifth row 135 in the radial direction, the length of the plenum in the direction of the axis O is reduced.

To be specific, the flow velocity of the fuel gas F circulating in the circumferential spaces between the premixing tubes 13 in the radial direction is defined as v. The flow velocity v is determined by a unit flow rate G of the fuel gas F and a flow passage area S of a cross-section (e.g., see a II-II cross-section illustrated in FIG. 2) that is orthogonal to the axis O at a position of each row. The flow passage area S is determined by a number N of the premixing tubes 13 that are disposed, a circumferential distance t between the premixing tubes 13 in each row, and a length L of the plenum at a position of each row in the direction of the axis O.

When the circumferential distance t is the same between the premixing tubes 13 in each row, the number of premixing tubes 13 is increased in the plenum toward the outer side in the radial direction, and the number of flow passages between the neighboring premixing tubes 13 is also increased. On the other hand, the fuel gas F circulating in the plenum is supplied to the premixing tubes 13 that are disposed in the first row 131 located at the inner side in the radial direction. For this reason, the flow rate of the fuel gas F is reduced until the fuel gas reaches the premixing tubes 13 disposed in the fifth row 135 located at the outer side in the radial direction.

When a row located at the innermost side in the radial direction is set as the first row 131, the length of the plenum in an a-th row in the direction of the axis O is defined as La, the number of premixing tubes 13 in the a-th row is defined as Na, and a volume flow rate of the fuel gas F in the a-th row is defined as Ga, a volume flow rate ratio between the a-th row and the first row 131 is expressed by Formula 1 below.

$$Ga/G1=(t\times Na\times La)/(t\times N1\times L1) \quad \text{(Formula 1)}$$

L1: the length of the premixing tubes 13 in the first row in the direction of the axis O G1: the volume flow rate of the fuel gas F in the first row N1: the number of premixing tubes 13 in the first row Therefore, the length La of the premixing tubes 13 in the a-th row in the direction of the axis O is calculated as in Formula 2 below and set.

$$La=L1\times(Ga/G1)\times(N1/Na) \quad \text{(Formula 2)}$$

The premixing tube support 14 has the same circular cross-section as the downstream support plate 12, and has the shape of a column extending in the direction of the axis O. The premixing tube support 14 is formed with a plurality of through-holes into which the premixing tubes 13 are inserted. The premixing tube support 14 is fixed integrally to the downstream support plate 12. The premixing tube support 14 extends such that a downstream end face thereof is flush with downstream ends of the premixing tubes 13. The premixing tube support 14 fixes the premixing tubes 13 by means of the downstream end face thereof.

Further, the premixing tube support 14 may support the premixing tubes 13 protruding from the downstream support plate 12. The premixing tube support 14 may, for example, be a tabular member that is disposed at a position separated from the downstream support plate 12 toward the downstream side in the shape of a disc whose center is the axis O and supports the premixing tubes 13.

Next, an operation of the fuel injector 10 having the above constitution will be described.

In the fuel injector 10 of the present embodiment as described above, the fuel gas F is introduced from the upstream side, which is the first end side in the direction of the axis O, into the plenum via the fuel delivery tube 1. The introduced fuel gas F flows toward the outer side in the radial direction along the shape of the upstream support plate 11 whose diameter gradually enlarges. Thus, the fuel gas F reaches the fuel introduction holes 13*a* formed in the plenums of the premixing tubes 13 disposed in the first row 131, and flows into the premixing tubes 13. Afterwards, the fuel gas F flows to the outer side in the radial direction toward the premixing tubes 13 disposed in the second row 132, and flows from the fuel introduction holes 13*a* into the premixing tubes 13. Likewise, the fuel gas F flows toward the outer side in the radial direction in the third row 133 and fourth row 134 in turn, arrives at the fuel introduction holes 13*a* of the premixing tubes 13 disposed in the fifth row 135, and flows into the premixing tubes 13 disposed in the fifth row 135.

While the fuel gas F flows towards the outer side in the radial direction from the premixing tubes 13 of the first row 131 to the premixing tubes 13 of the fifth row 135, the fuel gas F is sequentially introduced into the premixing tubes 13 from the first row 131. For this reason, an amount of the fuel gas F in the plenum is reduced. Further, the number of premixing tubes 13 is increased toward the outer side in the radial direction. Thereby, the number of flow passages formed in the circumferential space between the neighboring premixing tubes 13 is increased. However, the upstream support plate 11 is formed to reduce the length of the plenum in the direction of the axis O toward the outer side in the radial direction. As a result, a flow passage area of the fuel gas F directed in the radial direction is reduced in a cross-section parallel with the axis O, and a flow velocity is increased as the fuel gas F is directed to the outer side in the radial direction. For this reason, the fuel gas F flowing at the same flow velocity flows into the fuel introduction holes 13*a* of the premixing tubes 13 from the first row 131 to the fifth row 135 in which a radial distance from the axis O is gradually increased. Thereby, an amount of supply of the fuel gas F supplied into the premixing tubes 13 is constant.

Thus, air A introduced from the upstream side that is the first end side in the direction of the axis O and the fuel gas F supplied into the premixing tubes 13 are mixed in the premixing tubes 13. And air A and the fuel gas F are injected and discharged from the downstream side that is the second end side in the direction of the axis O.

According to the fuel injector 10 as described above, the plenum defined inward by the upstream support plate 11 having the shape of a tapered cylinder whose diameter gradually enlarges toward the downstream side that is the second end side in the direction of the axis O and by the downstream support plate 12 having the shape of a flat plate intersecting the axis O. The plenum can be formed to reduce a distance in the direction of the axis O from the center in the radial direction (the axis O) to the outer side in the radial direction. For this reason, the flow rate of the fuel gas F is gradually reduced in the plenum toward the outer side in the radial direction. The fuel gas F is supplied from the fuel introduction holes 13*a* to the plurality of premixing tubes 13 from the first row 131 to the fifth row 135 such that the radial distance from the axis O gradually increases. Thus, even if the number of remixing tubes 13 is increased, the flow velocity of the fuel gas F can be maintained to be constant. As a result, the flow rate of the fuel gas F supplied from the fuel introduction holes 13*a* positioned in the plenum into the premixing tubes 13 can be made constant regardless of the positions at which the premixing tubes 13 are disposed. For this reason, the air A and the fuel gas F can be uniformly mixed by the premixing tubes 13. Thereby, the uniformly mixed fuel gas F can be easily injected.

The upstream support plate 11 having the shape of the tapered cylinder whose diameter gradually enlarges toward the downstream side that is the second end side in the direction of the axis O can be checked from the outside. As a result, the shape of the upstream support plate 11 is minutely adjusted from the outside, and the shape of the plenum can be easily changed. Thus, it is possible to change a state in which the diameter of the upstream support plate 11 is enlarged according to the disposition of the premixing tubes 13 and the number of the premixing tubes 13 disposed. For this reason, it is possible to adjust the flow velocity of the fuel gas F circulating in the plenum. Thereby, the supply amount of the fuel gas F supplied to the premixing tubes 13 can be easily made constant.

The lengths of the plenums located in the rows whose radial dimensions from the axis O are different from each other are set such that the flow velocity of the fuel gas F circulating in the circumferential space between the premixing tubes 13 in the radial direction is constant. For this reason, even if the number of flow passages is increased with the increase of the premixing tubes 13, the flow passage area of the fuel gas F flowing in the plenum within a surface parallel to the axis O can be adjusted depending on the flow rate of the fuel gas F flowing in the plenum in each row. Thereby, it is possible to make the radial flow velocity constant with high precision, and easily inject the fuel gas F that is more uniformly mixed.

Also, the length of the plenum in the direction of the axis O is decided according to the number of premixing tubes 13 and the volume flow rate of the fuel gas F in each row. For this reason, the flow passage area of the fuel gas F flowing in the plenum within the surface parallel to the axis O in each row can be more accurately adjusted to the flow passage area of the cross-section perpendicular to the axis O. Thereby, the radial flow velocity can be made constant with high precision, and the fuel gas F that is more uniformly mixed can be injected.

Further, the premixing tubes 13 protrude toward the outside of the plenum in the direction of the axis O and toward the downstream side relative to the downstream support plate 12. Thereby, the lengths of all of the premixing tubes 13 are able to extend to the second end side in the direction of the axis O relative to the lengths of the premixing tubes 13 disposed in the plenum. The plenum is formed such that the distance thereof in the direction of the axis O is reduced from the axis O toward the outer side in the radial direction. The lengths of the premixing tubes 13 disposed in the plenum are shortened toward the outer side in the radial direction. The loss of pressure generated on the premixing tubes 13 decreases in proportion to a decrease in the lengths of the premixing tubes 13 extending in the direction of the axis O, because the premixing tubes 13 are pipe members. For this reason, in the premixing tubes 13 disposed in the plenum, the loss of pressure is reduced toward the outer side in the radial direction, and a magnitude of the loss of pressure is changed due to radial positions at which the premixing tubes 13 are disposed from the axis O. For this reason, the amount of supply from the fuel introduction holes 13*a* to the premixing tubes 13 is increased toward the outer side in the radial direction, and thereby a difference occurs. A difference in an amount of the air flowing in the premixing tubes 13 occurs, and a premixed gas cannot be uniformed and supplied.

However, the premixing tubes 13 extend toward the outside of the plenum, and thereby a percentage of the difference of the pressure loss of the premixing tubes 13 disposed in different radial positions can be reduced. For this reason, regardless of the positions at which the premixing tubes 13 are disposed, the amount of supply of the fuel gas F can be made uniform, and the more uniformly mixed fuel gas F can be easily injected.

Next, a fuel injector 10 of a second embodiment will be described with reference to FIG. 3.

In the second embodiment, the same components as the first embodiment are given the same signs and symbols, and detailed description thereof will be omitted. The fuel injector 10 of the second embodiment is different from that of the first embodiment in that a plurality of disposed premixing tubes 23 have the same length.

Figure 3:
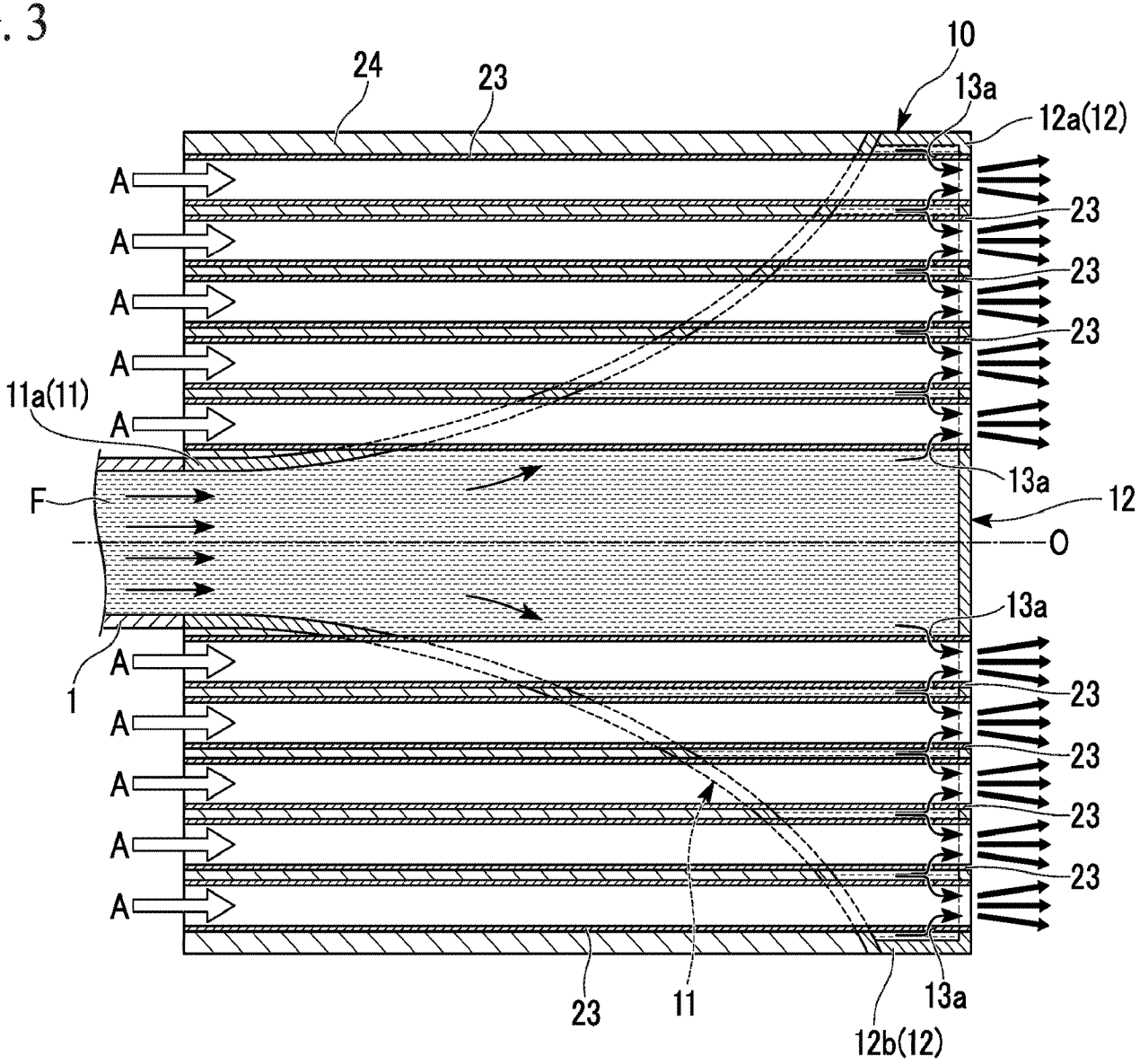
FIG. 3 is a longitudinal cross-sectional view showing a fuel injector according to a second embodiment of the present invention.

That is, as illustrated in FIG. 3, in the second embodiment, the fuel injector 10 has premixing tubes 23 that protrude to a first end side in the direction of the axis O toward the outside of a plenum with the same lengths, an upstream premixing tube support 24 that supports the premixing tubes 23 at the upstream side of an upstream support plate 11, and the same upstream and downstream support plates 11 and 12 as the first embodiment.

The premixing tubes 23 are pipe members that have the same cross-sectional shape as in the first embodiment, extend in the direction of the axis O, and have cylindrical shapes. The premixing tubes 23 is formed fuel introduction holes 13*a* penetrating the premixing tubes 23 from outside to inside at a portion located in a plenum. The premixing tubes 23 are fixed in a state in which the first end side in the direction of the axis O protrudes from the upstream support plate 11 toward an upstream side which is the first end side in the direction of the axis O and the outside of the plenum. The premixing tubes 23 are fixed such that the second end sides thereof in the direction of the axis O are flush with the downstream support plate 12 without protruding from the downstream support plate 12. The plurality of premixing tubes 23 have the same length, and are separated into concentric circles whose center is the axis O. Similarly to the first embodiment, the premixing tubes 23 are disposed in numerous rows in a radial direction, and thereby the number of the premixing tubes 23 is radially increased around the axis O. Similarly to the first embodiment, the premixing tubes 23 are also disposed in five rows in the second embodiment.

An upstream premixing tube support 24 has a cylindrical shape with an interior that is recessed to correspond to a shape of the enlarged diameter part 11*a* of the upstream support plate 11. The upstream premixing tube support 24 is disposed to cover the upstream support plate 11 from the upstream side that is the first end side in the direction of the axis O. That is, the upstream premixing tube support 24 is fixed integrally to the upstream support plate 11, and thereby an external shape is a columnar shape along the upstream and downstream support plates 11 and 12 defining the plenum. The upstream premixing tube support 24 has a plurality of through-holes extending in the direction of the axis O. The upstream premixing tube support 24 fixes the premixing tubes 23 by means of an upstream end face to cause the premixing tubes 23 to be inserted into the through-holes and to be flush with upstream ends of the premixing tubes 23. Similarly to the premixing tube support 14, the upstream premixing tube support 24 may support the premixing tubes 23 protruding from the upstream support plate 11. The upstream premixing tube support 24 may be, for example, a tabular member that is separated from the upstream support plate 11 at the upstream side and is disposed in the shape of a disc whose center is the axis O.

According to the fuel injector 10 of the second embodiment as described above, the lengths of the premixing tubes 23 in the direction of the axis O are made equal regardless of the positions at which they are disposed, and thereby the lengths of the premixing tubes 23 in the direction of the axis O are made equal regardless of the positions at which they are disposed. For this reason, a loss of pressure in the premixing tubes 23 disposed at different radial positions can be constant. As a result, an amount of supply of a fuel gas F from the fuel introduction holes 13*a* into the premixing tubes 23 can be made constant regardless of the radial positions at which they are disposed. Thereby, it is possible to easily inject the more uniformly mixed fuel gas F.

Next, a fuel injector 10 of a third embodiment will be described with reference to FIG. 4.

In the third embodiment, the same components as the first embodiment are given the same signs and symbols, and detailed description thereof will be omitted. The fuel injector 10 of the third embodiment is different from that of the first embodiment in that it has a fuel guide 3 for guiding a fuel gas F into a plenum.

Figure 4:
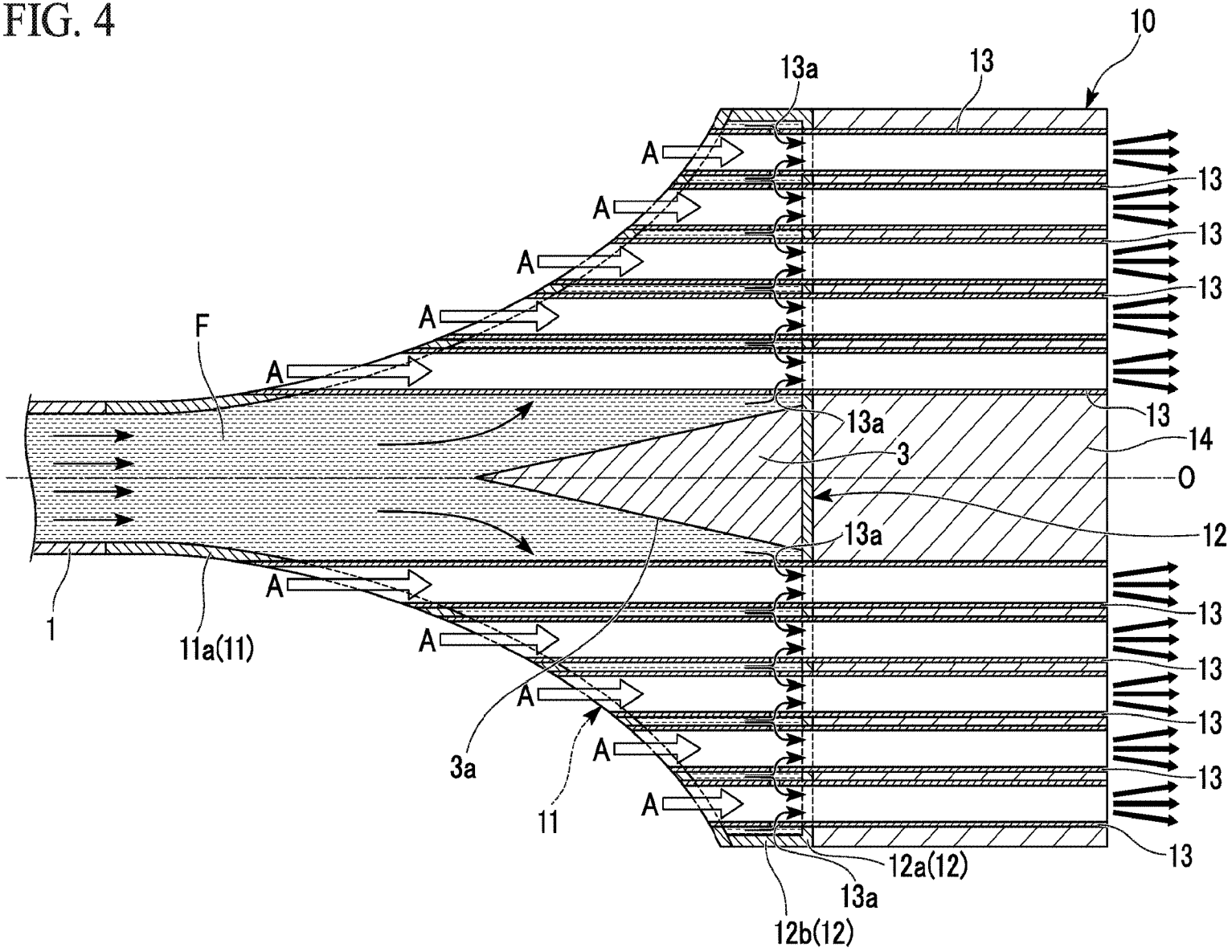
FIG. 4 is a longitudinal cross-sectional view showing a fuel injector according to a third embodiment of the present invention.

That is, as illustrated in FIG. 4, in the third embodiment, the fuel injector 10 further includes the fuel guide 3 whose diameter gradually enlarges around the axis O from the first end side in the direction of the axis O to the second end side in the direction of the axis O.

The fuel guide 3 has a conical bottom fixed to a first end face of a downstream support plate 12 in a plenum in the direction of the axis O. The fuel guide 3 has a conical shape with a tapered surface 3*a* whose diameter gradually enlarges around the axis O from the upstream side that is the first end side in the direction of the axis O to the downstream side that is the second end side in the direction of the axis O.

According to the fuel injector 10 of the third embodiment as described above, the fuel guide 3 whose center is the axis O has the conical shape with the tapered surface 3*a* whose diameter gradually enlarges from the upstream side that is the first end side in the direction of the axis O to the downstream side that is the second end side in the direction of the axis O. For this reason, a fuel gas F introduced into a plenum via a fuel delivery tube 1 flow to an outer side in a radial direction along a shape of the fuel guide 3. That is, the fuel gas F introduced into the plenum is guided toward the outer side in the radial direction by the fuel guide 3, and circulation toward the outer side in the radial direction becomes easier. For this reason, the fuel gas F is also easily supplied to premixing tubes 13 disposed at the outer side in the radial direction. As a result, regardless of positions at which the premixing tubes 13 are disposed, the amount of the fuel gas F supplied from the fuel introduction holes 13*a* can be made constant with higher precision. Thereby, it is possible to easily inject the fuel gas F that is uniformly mixed with high precision.

The present invention is not limited to the aforementioned embodiments, and various modifications are possible without departing from the gist thereof. For example, a modification of the present embodiment may include a fuel injector 10 having both the second embodiment and the third embodiment.

Figure 5:
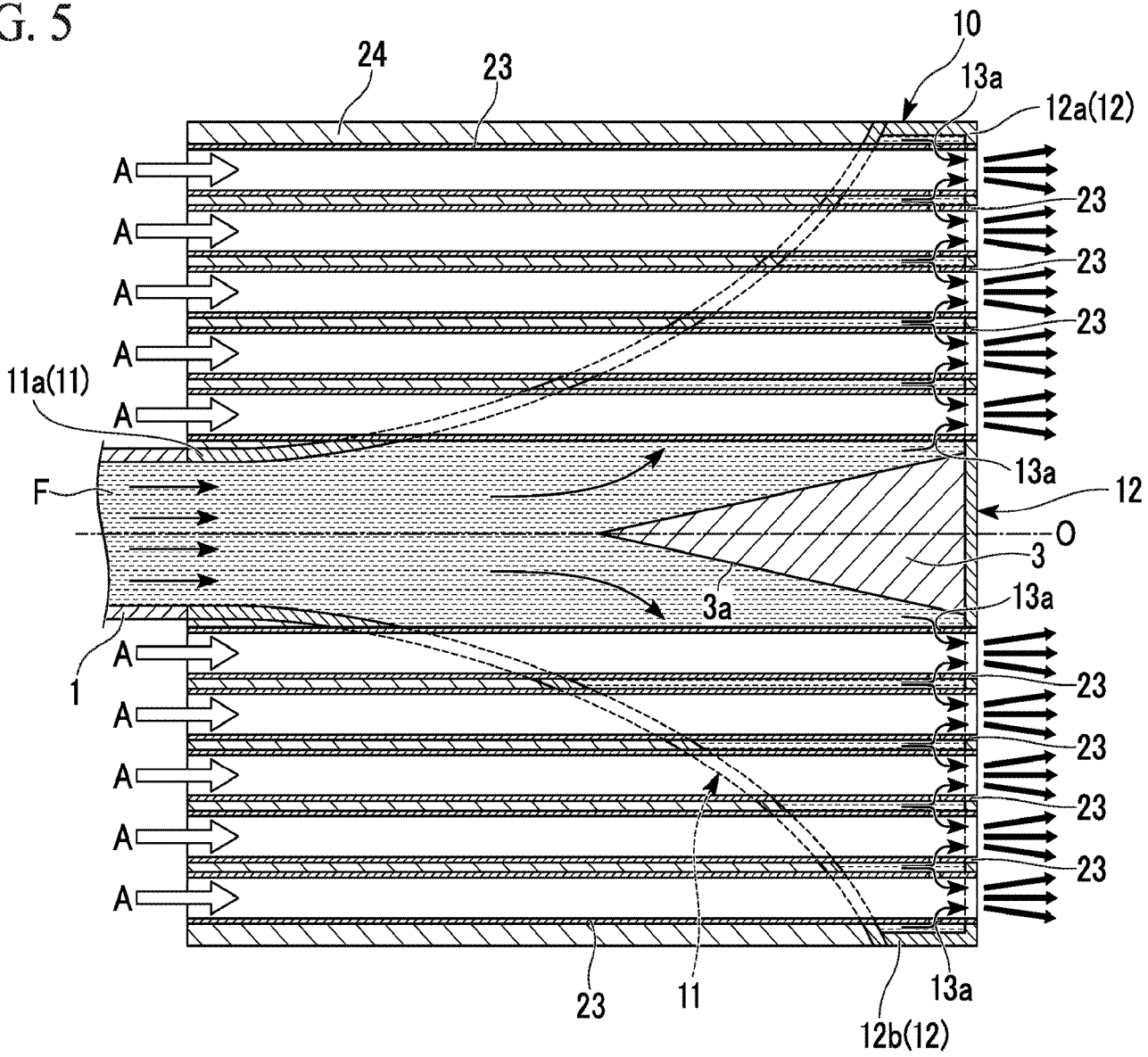
FIG. 5 is a longitudinal cross-sectional view showing a fuel injector according to a first modification of the present invention.

That is, as illustrated in FIG. 5, in the modification, the fuel injector 10 of the second embodiment may have a fuel guide 3.

While embodiments of the present invention have been described in detail with reference to the drawings, the constitutions of the embodiments and combinations thereof are examples, and additions, omissions, substitutions, and other variations of the constitutions are possible without departing from the spirit and scope of the present invention. Also, the present invention is not limited to the embodiments, but is limited only by the scope of the claims.

In the present embodiment, the premixing tubes 13 protrude from the upstream side that is the first end side in the direction of the axis O or the downstream side that is the second end side in the direction of the axis O, but the protruding direction is not limited to that of the present embodiment. The premixing tubes 13 may protrude in a different direction or in opposite directions. For example, as in the second embodiment, the premixing tubes 23 having the same length may protrude toward the downstream side.

Further, the plurality of premixing tubes 13 are disposed around the axis O in the five rows, but are not limited to the five rows. The rows may be appropriately selected according to performance of the required fuel injector 10.

Also, the premixing tube support 14 is preferably provided to maintain the premixing tubes 13 in a posture parallel with the axis O, but it may not be provided. In this case, the premixing tubes 13 preferably support themselves with their own strength and maintain a posture parallel with the axis O.

Further, the present invention is not limited to the constitution in which the length of the plenum in the direction of the axis O is set to make the radial flow velocity constant. For example, the length of the plenum in the direction of the axis O may be set to make the flow velocity of the fuel gas F in a flow direction of the fuel gas F having a component in not only the radial direction but also the direction of the axis O constant.

INDUSTRIAL APPLICABILITY

According to the aforementioned fuel injector, the plenum is formed to reduce an axial distance from the center of the axis to the outer side in the radial direction. Thereby, it is possible to easily inject the uniformly mixed fuel gas.

REFERENCE SIGNS LIST

O axis
F fuel gas
A air
1 fuel delivery tube
10 fuel injector
11 upstream support plate
11*a* enlarged diameter part
12 downstream support plate
12*a* disc part
12*b* cylindrical part
13, 23 premixing tube
13*a* fuel introduction hole
131 first row
132 second row
133 third row
134 fourth row
135 fifth row
14 premixing tube support
24 upstream premixing tube support
3 fuel guide

The invention claimed is:

1. A fuel injector configured to introduce a fuel gas and air from an upstream side of the fuel injector and inject a premixed gas of the fuel gas and the air from a downstream side of the fuel injector, the fuel injector comprising:

a fuel delivery tube configured to introduce the fuel gas;

an upstream support plate at a downstream side of the fuel delivery tube, the upstream support plate being connected with the fuel delivery tube;

a downstream support plate at a downstream side of the upstream support plate, the downstream support plate including a cylindrical part and a disc part connected with the cylindrical part;

a plenum having outer limits defined by an end of the fuel delivery tube, the upstream support plate and the downstream support plate; and premixing tubes configured to introduce the air from the upstream side of the fuel injector, to be supplied with the fuel gas from the plenum, to inject the premixed gas from the downstream side of the fuel injector, and to be supported on the upstream support plate and the downstream support plate, wherein a radial distance between a central axis of the fuel injector and a side of the upstream support plate increases toward the cylindrical part of the downstream support plate, wherein a cross-sectional area of the plenum is greatest in a part of the plenum defined by the downstream support plate, wherein the premixing tubes extend straight from an upstream end configured to introduce the air to a downstream end configured to inject the premixed gas, and wherein the fuel injector is configured to radially inject the fuel gas outward from the fuel delivery tube using fuel injection holes at a location upstream of the disc part.

2. The fuel injector according to claim 1, wherein the side of the upstream support plate is arcuate.

* * * * *